United States Patent [19]

Hagerup

[11] Patent Number: 5,020,227

[45] Date of Patent: Jun. 4, 1991

[54] RADEI—A BEAM COMPASS

[76] Inventor: Carl F. Hagerup, 4900 Thane Rd., Juneau, Ak. 99801

[21] Appl. No.: 228,253

[22] Filed: May 17, 1989

Related U.S. Application Data

[63] Continuation of Ser. No. 896,807, Aug. 15, 1986, abandoned.

[51] Int. Cl.[5] ..... B43L 9/04
[52] U.S. Cl. ..... 33/27.03
[58] Field of Search ..... 33/27.03, 27.031, 27.032, 33/27.033

[56] References Cited

U.S. PATENT DOCUMENTS 2,474,864 7/1949 Roedding ..... 33/27.031
2,608,766 9/1952 Theim ..... 33/27.031

*Primary Examiner*—Harry N. Haroian

[57] ABSTRACT

This invention is a beam compass with a new type of adjustable trammel, featuring a polyproplene plastic which eliminates the need for screw or spring loaded clamps and is self locking on beam and is adjusted by merely pushing the trammel plastic where said plastic contacts the top of the beam. This invention also features a unique method of holding a marking member near the end of the beam and this feature also provides a place in the end of the beam to store the sharp point of the trammel when it is not being used.

1 Claim, 3 Drawing Sheets

RADEI—A BEAM COMPASS

This is a continuation of Ser. No. 06/896,807 filed Aug. 15, 1986, now abandoned.

This invention relates to the type of drafting instrument known as a beam compass.

A primary object of this invention concerns the simplification of the mechanics involved in drawing a measured radius.

A further object is to provide safe storage of carriage assembly and pivot point/indicator.

A further object is to accomplish the aforementioned objectives by mechanism and design efficiently and simply with inexpensive replacement costs.

Other objectives are manifested in the following disclosure.

A primary feature of the present invention is the grippingly engaging characteristic of carriage assembly. Other features are manifested in the following disclosure.

In the drawings forming part of the specification:

Figure 1:
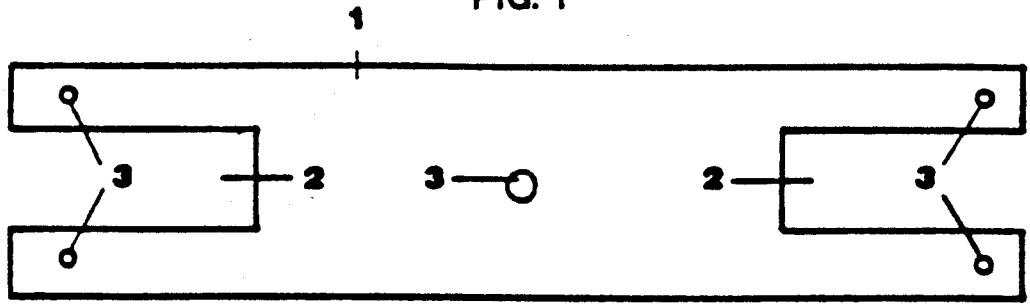
FIG. 1 is a plan view of the polyproplene sheet material.
Figure 2:
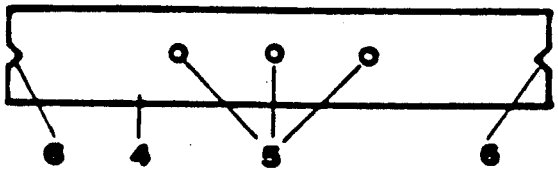
FIG. 2 is a plan view of metal sheet material.
Figure 3:
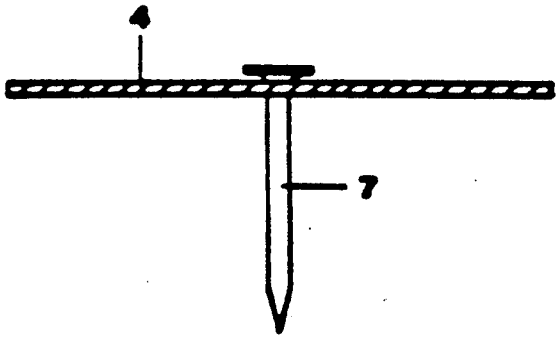
FIG. 3 is an edge view of metal sheet with pointer member.
Figure 4:
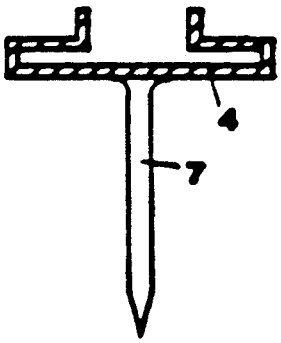
FIG. 4 is a side view of pivot point/indicator.
Figure 5:
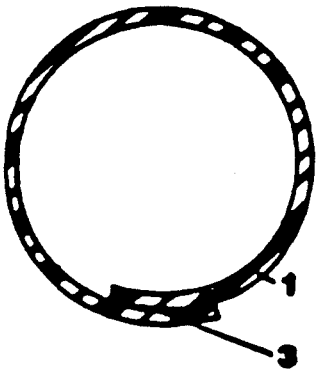
FIG. 5 is a side view of polyproplene loop configuration.
Figure 6:
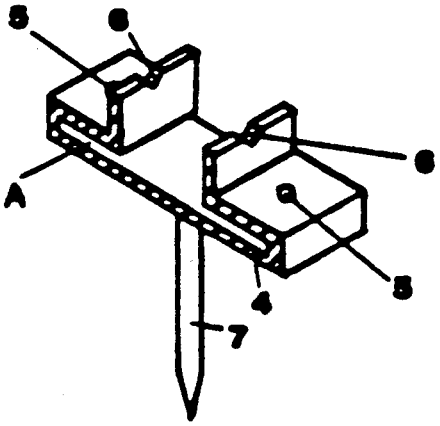
FIG. 6 is a perspective view of pivot point/indicator.

In accordance with FIG. 1 polyproplene material (1) is provided with rectangular apertures (2) congruent to perimeter of graduated beam (14) and five circular apertures (3), one at each corner and midpoint of polyproplene material (1), for manufacturing purposes. In accordance with FIG. 2 metal clamp (4) sheet is provided with three circular apertures (5) in propinquity to one another for manufacturing purposes, and angular indentations (6) to be used for aligning point member (7) with units of measurement along said graduated beam (14). As manifested in FIG. 3 pivot point member (7) is inserted therethrough central circular aperture (5) of metal clamp (4) sheet and permanently affixed and made flush thereto, by customary means, as exhibited in FIG. 4 wherein metal clamp (4) sheet is transformed, by any customary manufacturing process, to enable metal clamp (4) to house aforementioned polyproplene material (1) by means of aligning polyproplene sheet (1) corner apertures (3) jointly within concavity (A) of metal clamp (4), as manifested in FIG. 6, thereby forming loop configuration denoted in FIG. 5 and furthermore aligning said joined circular apertures (3) with the two remaining aforementioned metal clamp (4) circular apertures (5) manifested in FIG. 6, assemblage consummated by means of any customary method of adhesion.

Figure 7:
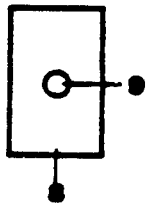
FIG. 7 is a plan view of rigid washer.
Figure 8:
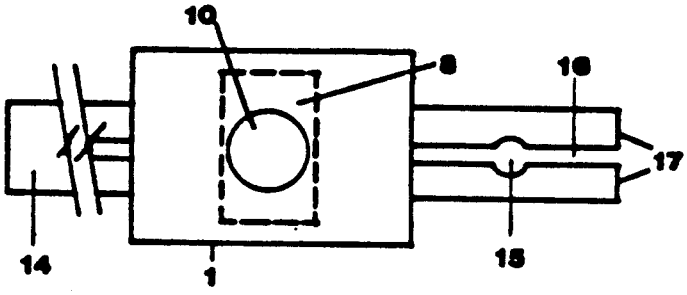
FIG. 8 is a plan view of rigid washer placement.
Figure 9:
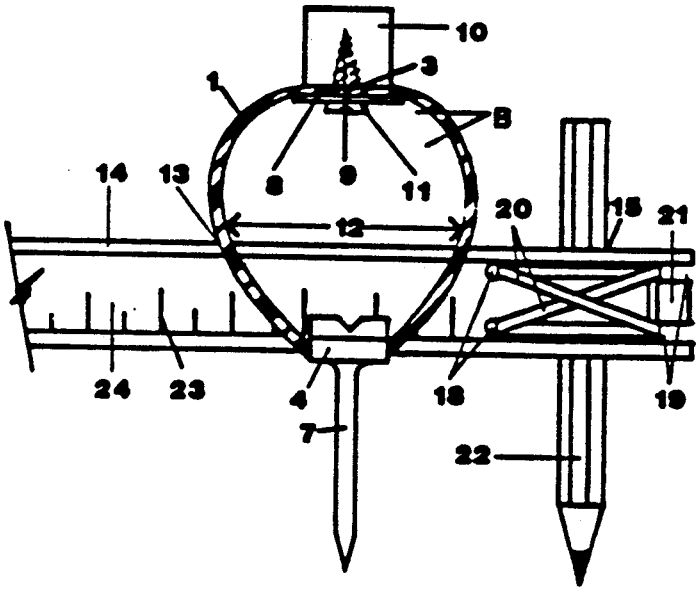
FIG. 9 is a side view of integrated members.

In accordance with FIG. 7 rectangular rigid washer (8) is provided with a means circular aperture (9) enabling washer (8) to be securely fastened onto underside median of aforementioned loop configuration as denoted in FIG. 8 by means of positioning porous knob (10) above washer (8) and atop center of loop configuration, and, as manifested in FIG. 9, inserting wood screw (11) upwardly therethrough circular aperture (9) of washer (8), available central aperture (3) of aforementioned polyproplene material (1) and porous knob (10) until flush thereto, thereby creating a bend in loop configuration apex (B) resulting in outward exertion (12) against sides of and within loop configuration providing effectual friction at junction (13) of beam (14) and polyproplene material (1).

Figure 10:
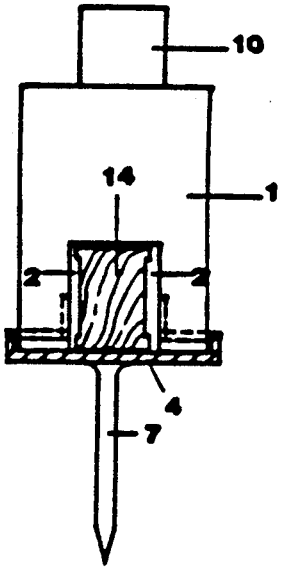
FIG. 10 is an end view of carriage and graduated beam.

As manifested in FIG. 8 beam (14) end is provided with scriber aperture (15) therethrough and vertical slit (16) extending four to five inches from beam (14) end and intersecting scriber aperture (15) thereby forming two resilient arm members (17) at beam (14) end. Furthermore, as denoted in FIG. 9, beam (14) is provided with a pair of through apertures (18) extending transversely to and adjacent to scriber aperture (15), a pair of horizontal grooves (19) in beam (14) end orthogonally intersecting certical slit (16) and resilient means (20) threaded through said through apertures (18) engaging horizontal grooves (19), and knob (21) thereof, thereby creating inward pressure on resilient arms (17) of holding scriber (22) in scriber aperture (15). Furthermore, beam (14) is graduated by means of units (23) of measurements along the length of dadoed sides (24). FIG. 10 denotes the integration of carriage assembly with graduated beam (14) by means of longitudinally inserting said beam (14) therethrough aforementioned polyproplene material (1) congruent apertures (2).

Figure 11:
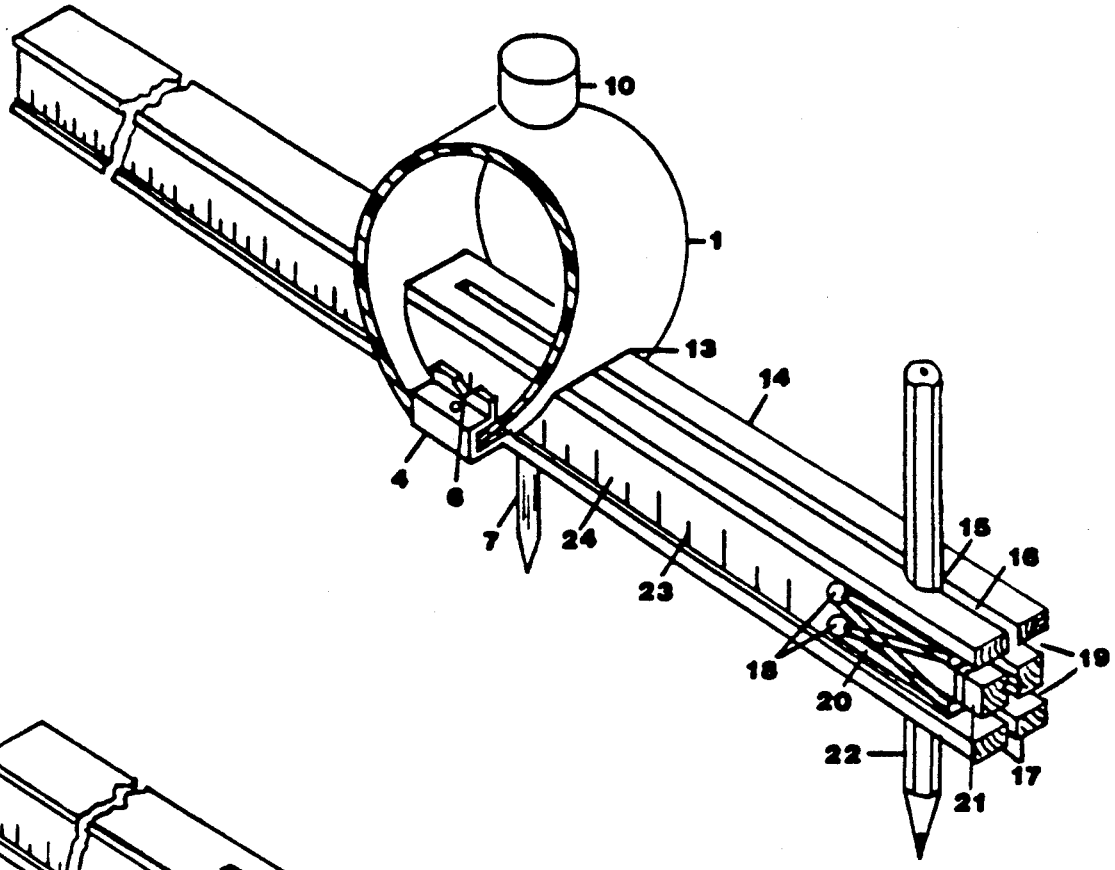
FIG. 11 is a perspective view of present invention.

Having been positioned atop graduated beam (14), as shown in FIG. 11, carriage assembly is longitudinally slideable along said beam (14) by means of finger pressure applied to junction (13) of loop configuration and beam (14) surface for measured movement or open movement by means of equal exertion applied to both sides of polyproplene material (1) loop configuration thereby positioning carriage assembly at desired location by means of aligning indicator (6) of metal clamp (4) with units (23) of measurement denoted along dadoed sides (24) of graduated beam (14) thereby allowing for desired radius by means of applying steadfast finger pressure upon knob (10) atop said carriage assembly while simultaneously moving aforementioned scriber (22) in arc direction.

Figure 12:
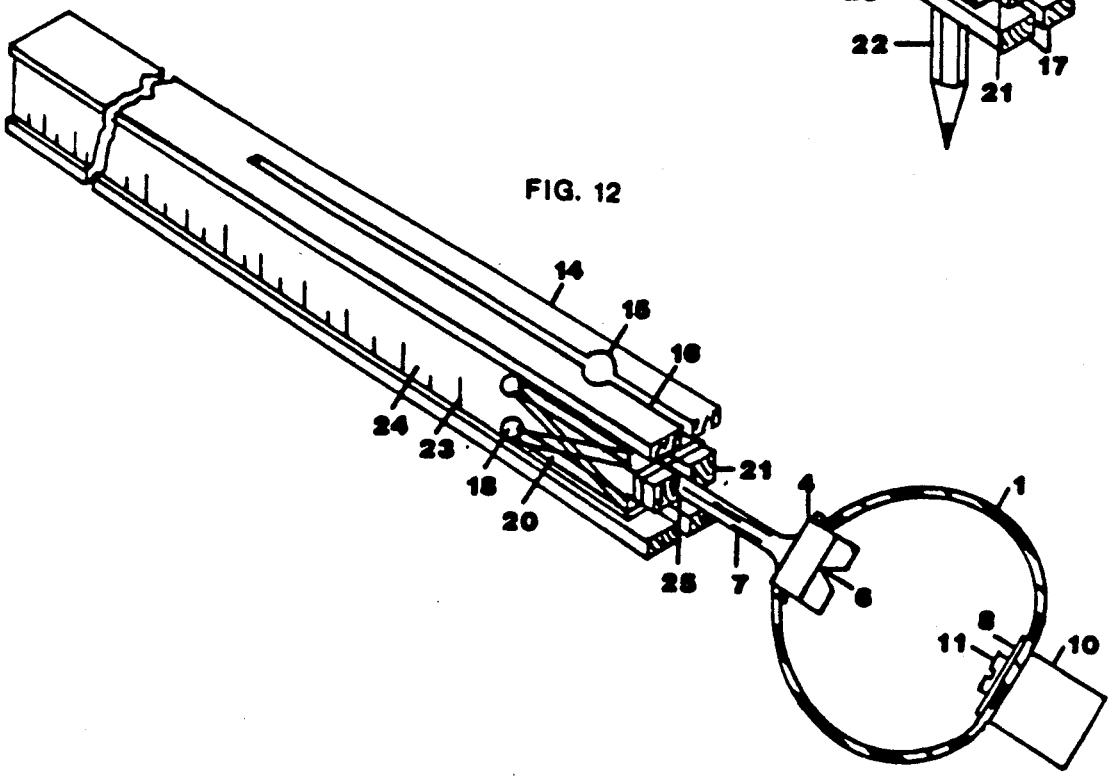
FIG. 12 is a perspective view of storage feature.

Furthermore, as exhibited in FIG. 12, carriage assembly is resiliently stored within said beam (14) end means of inserting point member (7) therein central aperture (25) of resilient beam end knobs (21).

I claim:

1. A beam compass comprising an elongated graduated beam member, a carriage having a hollow resilient body portion connected to a pivot point/indicator assembly, said resilient portion having an aperture therethrough adjacent said assembly for normally grippingly engaging and encompassing said graduated beam, said carriage being movable along said beam by application of finger pressure to said resilient portion to thereby release the normal gripping engagement of said body portion and beam, said carriage having a knob atop said resilient body portion and a pointed pivot member attached to the pivot point assembly, said beam adjacent and end thereof having an aperture therethrough for receiving an elongated scriber in parallel relation with said pivot member, said beam including means for resiliently retaining said scriber in said aperture, said means comprising a vertical slit extending past and intersecting said scriber aperture thereby forming two resilient arm members at said beam end, a pair of through apertures in the beam extending transversely to and adjacent said scriber aperture and a pair of horizontal grooves in said beam end orthogonally intersecting said vertical slit, and resilient means threaded through, said through apertures and engaging said horizontal grooves for creating inward pressure on the resilient arms for holding said scriber in said aperture.

* * * * *